US006155020A

United States Patent [19]

Deem

[11] Patent Number: 6,155,020

[45] Date of Patent: Dec. 5, 2000

[54] SHREDDED CARPET INSULATION

[76] Inventor: Thomas Deem, 108 Stahl Dr., Philo, Ill. 61801

[21] Appl. No.: 09/323,217

[22] Filed: Jun. 1, 1999

Related U.S. Application Data

[62] Division of application No. 09/141,056, Aug. 27, 1998.

[51] Int. Cl.[7] ..... E04B 1/00

[52] U.S. Cl. ..... 52/742.13; 52/741.1; 241/24.12

[58] Field of Search ..... 52/741.1, 745.05, 52/742.13

[56] References Cited

U.S. PATENT DOCUMENTS 4,842,928 6/1989 Kielmeyer .
5,516,580 5/1996 Frenette et al. .
5,518,188 5/1996 Sharer .
5,535,945 7/1996 Sferrazza et al. ..... 241/24.12
5,582,905 12/1996 Beck et al. .
5,719,198 2/1998 Young et al. .
5,724,783 3/1998 Mandish ..... 52/745.05
5,855,664 1/1999 Bielecki et al. ..... 106/697

*Primary Examiner*—Carl D. Friedman
*Assistant Examiner*—Patrick J. Chavez
*Attorney, Agent, or Firm*—Berns Law Office, PC; Michael Berns

[57] ABSTRACT

The present invention provides an economical and efficient insulation material formed from recycled carpet waste. Carpet waste is readily available and is currently landfilled. The resulting insulation product of the invention is a high-efficiency, low-cost building insulation material.

10 Claims, 1 Drawing Sheet

SHREDDED CARPET INSULATION

This application is a division of Ser. No. 09/141,056 filing date Aug. 27, 1998.

FIELD OF THE INVENTION

This invention relates to insulation products, more particularly the processing of used carpet into building insulation material. Used or scrap carpet is shredded into small pieces of carpet fibers and utilized as a building insulation product.

DESCRIPTION OF THE PRIOR ART

The use of blown insulation composed of cellulose, fiberglass, rockwool, and other materials is well known. Using blown insulation rather than batt insulation is often preferred by home construction contractors because it can be easily and quickly applied to new and old buildings. The materials and equipment is readily available, and the blown insulation is a relatively low-cost material.

Fiberglass insulation has had health and safety concerns, and there is a need for an economically feasible alternative. Cotton insulation was tried in both blown and batt forms. Cotton has not provided the economical justification, nor any superior insulation benefits. Waste cotton products are available, however the process to form insulation is complex.

U.S. Pat. No. 5,057,168 to Muncrief discloses a method of making low density insulation composition. This patent involves melting insulating fibers and forming batt insulation. U.S. Pat. No. 5,535,945 to Sferrazza et al. discloses a carpet recycling process and system. This process uses the waste carpet to separate out the components to reform them into new carpeting. U.S. Pat. No. 5,518,188 to Sharer also discloses a method of recycling carpet forming components from waste carpet. U.S. Pat. No. 5,642,601 to Thompson, et al. discloses a method of forming thermal insulation based on cotton fibers from scrap materials.

BRIEF SUMMARY OF THE INVENTION

The ideal insulation has air voids to produce a high insulation rating, is capable of getting wet without matting, has the proper density to remain in place yet not burden the flooring, economically available. It is an object of this invention to provide an insulation product and a method of producing such an insulation product consisting mainly of recycled carpet fibers, in a low cost manner which overcomes the disadvantages and deficiencies of prior methods.

The foregoing object of the present invention is accomplished by forming the insulation from recycled carpet waste. Carpet waste is produced by the removal of old carpet, scraps from the installation of carpet, and during manufacturing. Every carpet installer has a large supply of waste carpet they need to get rid of. The current solution for them is to pay to have the waste carpet taken to a landfill.

REFERENCE NUMERALS USED IN THE DRAWINGS

Figure 1:
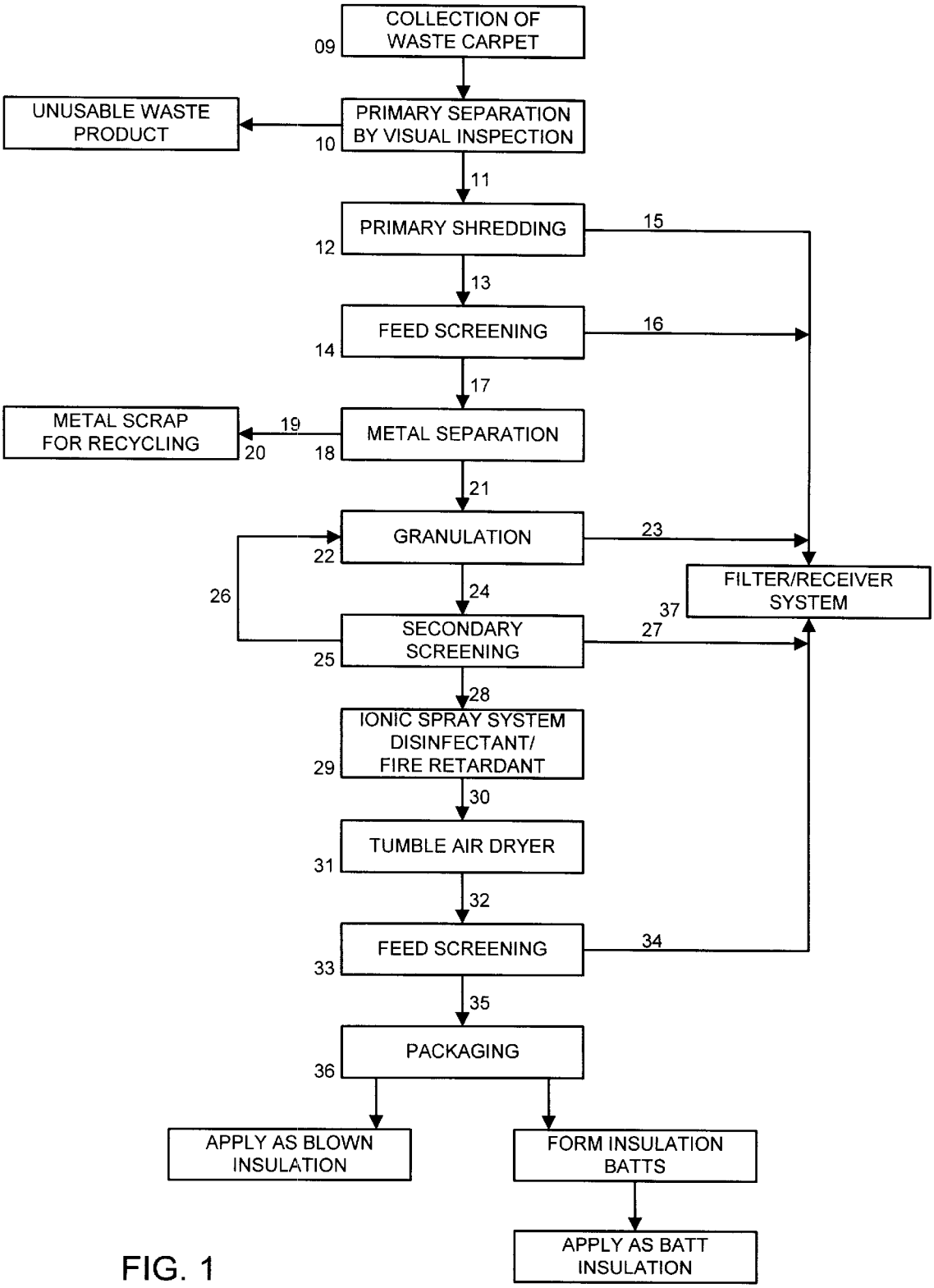
FIG. 1 is a schematic flow chart of the invention.

09 collection of waste carpet
10 primary separation by visual inspection
11 feed to primary shredder

12 primary shredding
13 feed to feed screen
14 feed screening
15 dust generated during shredding
16 waste feed to filter/receiver
17 feed to metal separator
18 metal separation
19 metal waste
20 metal scrap for recycling
21 feed to granulator
22 granulation
23 dust generated during granulation
24 feed to secondary screener
25 secondary screening
26 recycle to granulator
27 dust collected during screening
28 feed to ionic spray system
29 ionic spray system; disinfectant/fire retardant
30 treated face material
31 tumble air dryer
32 carpet face material
33 feed screening
34 loose backing material
35 feed to packaging
36 packaging
37 filter/receiver system

DETAILED DESCRIPTION OF THE PREFERRED EMBODIMENT

The basic processing steps of the present invention are shown schematically in accompanying FIG. 1. In this regard, the post consumer (i.e. waste) carpet in bailed or rolled form (09) is first visually inspected and separated from heavily contaminated waste in Step 10, so as to provide good quality material for processing. The remaining waste carpet can be virtually any synthetic (polymeric) carpet. Preferably, the waste carpet is nylon, nylon b 6,nylon 6.6, polyester, or polypropylene-composed. Typical clean, waste carpet is broken down by weight into the following components: 50% face material, 12% polypropylene backing, about 8% SBR latex adhesive, and 30% calcium carbonate filler material.

This material is then fed (11) into the primary shredder (12) so as to form strips of the waste carpet, preferably approximately 1½ inches wide and from 1 to 12 inches long. This strip material commonly has a bulk density of approximately 8.5–9 lb/cuft.

The waste carpet strips are then fed (13) onto a feed screen (14), while dust generated during shredding is transferred (15) to a central filter/receiver (37). The feed screen (14) will start the separation process by shifting some of the SBR latex adhesive, calcium carbonate filler, and polypropylene backing from the polymeric face fibers. The backing material separated from the screen feeder is transferred (16) to the filter/receiver.

The carpet strips are then fed (17) into a metal separator to remove any metals such as carpet staples, tacks, bailing wire, etc. This metal waste is discharged (19) to a waste container (20) for further recycling. While the carpet strips are then fed (21) into the primary granulator (22) to begin the reduction and dismantling of the carpet strips into a heterogeneous mixture of the carpet face fiber and backing material. Dust generated during granulation is transferred (23) to the filter/receiver (37). The mixture of granulated carpet and backing materials is then transferred to a feed screener (24) for separation which separates the top screen into over-sized pieces and returns the back to the granulator (26) for a second pass, while the middle screen collects the face tufts that are generally ¼ inch to 1 inch in length and have had the bulk of backing material removed. This feed is then transferred (28) through an ionic spray system (29) where the material can be treated with disinfectant and/or fire retardant additives, if desired. Dust collected during the screening is transferred (27) to the filter/receiver (37).

The treated face material, typically having an average bulk density of 3–4 lb/cuft, is transferred (30) to a tumble drying station (31) where the material drying process is accelerated and the disinfectant and/or fire retardant additives may set into the carpet face material. The carpet face material is then transferred (32) to a final feed screen (33) to remove any loose backing material that may remain or have been separated during the tumble drying operation. This material is transferred (34) to the filter/receiver (37). The material is then fed to a packing machine (36) for consumer insulation use or bailed for other industrial uses.

Carpet installation creates a large amount of waste carpeting, both in the removal of old carpeting, and the scraps of extra carpet from trimming during installation. The waste is currently being thrown away, at great expense to carpet installers, and great volumes of landfill material.

By collecting the carpet waste in large quantity, the material could be easily processed. The waste carpet is cut into strips which would fit into a shredder. The material is then shredded, which also separates much of the dirt trapped in the carpet. Shredders for tree shredding are appropriate. Waste carpet consists of carpet fibers, backing material, and contaminants. Large amounts of dirt are generally included in used carpet materials. The shredded carpet may be sprayed with a disinfectant or deodorizer. Waste carpet with the heaviest dirt and contamination would have to be rejected for recycling.

The shredded material produced is then used as blown insulation. Common pneumatic blowers used for blown cellulose insulation are appropriate for blowing the carpet fiber insulation.

The post consumer (waste) carpet is first shredded so as to form pieces of carpet fiber approximately 1 inch in length. The waste carpet fed into the shredder can be virtually any synthetic (polymeric) carpet.

The waste carpet shredded material is then transmitted by the force of the shredder blades to a materials recovery station. Pneumatically conveyed via a feed blower unit to the station. Since nylon particulate have different densities and aerodynamic properties, this separates the material into the nylon and backing portions. The flight of the carpet fibers sorts out heavier materials in the waste carpet. Dust is also created. In this process, a large amount of dirt is recovered and removed from the waste carpet. An ionizer can be used to dissipate/neutralize static electricity in the process. The shredded material is then agitated to remove more of the dirt and backing material from the nylon fibers.

Once the shredded materials are stockpiled, they are bagged, and taken to the insulation site. The insulation material is then fed into a standard pneumatic blower. The blower can be used to distribute the fibers over the flat surfaces of an attic, or enclosed spaces in a wall, or similar building insulation usage.

I claim:

1. A method of recycling used carpet, with steps comprising:

a) sorting waste carpet;

b) shredding the carpet; and c) blowing the carpet into buildings, wherein the carpet may be utilized as an insulation material.

2. A method of recycling used carpet, with steps comprising:

a) sorting waste carpet;

b) shredding said carpet; and c) forming said carpet into batts and applying said batt insulation into voids and attics of a building.

3. An insulation material comprised of shredded carpet fibers adapted to be blown into voids and attics of a building.

4. An insulation material according to claim 3 wherein said carpet fibers are selected from the group: nylon, nylon 6, nylon 6.6, polyester, and polypropylene.

5. A method of recycling used carpet according to claim 1 wherein shredding produces carpet fibers having a length of about 1 inch.

6. An insulation material according to claim 3 wherein said carpet fibers have a length of about 1 inch.

7. A method of insulating a building comprising blowing carpet fibers into voids and attics.

8. A method of insulating a building according to claim 7, wherein the carpet fibers are produced from recycled carpet.

9. A method of insulating a building comprising applying batt insulation made of carpet fibers into voids and attics.

10. A method of insulating a building according to claim 9, wherein the carpet fibers are produced from recycled carpet.

* * * * *